US009062926B2

(12) United States Patent
Lee

(10) Patent No.: US 9,062,926 B2
(45) Date of Patent: Jun. 23, 2015

(54) EXTRACTOR FOR A FIREARM

(71) Applicant: Apex Tactical Specialties, Inc., Los Osos, CA (US)

(72) Inventor: Randall M. Lee, Morro Bay, CA (US)

(73) Assignee: Apex Tactical Specialties, Inc., Los Osos, CA (US)

( * ) Notice: Subject to any disclaimer, the term of this patent is extended or adjusted under 35 U.S.C. 154(b) by 85 days.

(21) Appl. No.: 13/681,341

(22) Filed: Nov. 19, 2012

(65) Prior Publication Data

US 2014/0137454 A1 May 22, 2014

(51) Int. Cl.
*F41A 15/14* (2006.01)

(52) U.S. Cl.
CPC ..... *F41A 15/14* (2013.01)

(58) Field of Classification Search
CPC ..... F41A 15/00; F41A 15/12; F41A 15/14; F41A 15/16; F41A 15/08; F41A 15/10
USPC ..... 42/25, 46, 47
See application file for complete search history.

(56) References Cited

U.S. PATENT DOCUMENTS

| | | | | | |
|---|---|---|---|---|---|
| 1,317,587 | A * | 9/1919 | Mercie | 42/25 |
| 2,870,562 | A * | 1/1959 | Kimball | 42/25 |
| 2,894,346 | A * | 7/1959 | Smith | 42/69.03 |
| 3,733,729 | A * | 5/1973 | Baker | 42/23 |
| 3,882,625 | A * | 5/1975 | Tellie | 42/25 |
| 4,342,169 | A * | 8/1982 | Lichtman | 42/11 |
| 5,355,768 | A * | 10/1994 | Felk | 89/147 |
| 5,410,831 | A | 5/1995 | Felk | |
| 5,655,326 | A * | 8/1997 | Levavi et al. | 42/70.01 |
| 5,678,340 | A | 10/1997 | Moon | |
| 5,794,373 | A | 8/1998 | Moon | |
| 6,256,915 | B1 * | 7/2001 | da Silveira | 42/1.05 |
| 6,560,909 | B2 * | 5/2003 | Cominolli | 42/70.05 |
| 6,851,212 | B2 * | 2/2005 | Szabo | 42/25 |
| 6,966,137 | B2 * | 11/2005 | Gussalli Beretta | 42/46 |
| 7,322,143 | B2 * | 1/2008 | Rohrbaugh et al. | 42/71.02 |
| 7,380,362 | B2 * | 6/2008 | Curry et al. | 42/46 |
| 7,383,655 | B2 * | 6/2008 | McGarry | 42/1.05 |
| 7,478,494 | B2 * | 1/2009 | Zeh | 42/25 |
| 7,774,970 | B1 * | 8/2010 | McGarry | 42/1.05 |
| 8,028,454 | B1 | 10/2011 | Pontillo, II | |
| 8,156,677 | B2 * | 4/2012 | Glock | 42/71.02 |
| 2002/0194762 | A1 * | 12/2002 | Cominolli | 42/70.06 |
| 2004/0159032 | A1 * | 8/2004 | Szabo | 42/46 |
| 2005/0115127 | A1 * | 6/2005 | Szabo | 42/46 |
| 2005/0229456 | A1 * | 10/2005 | McGarry | 42/1.01 |
| 2005/0229458 | A1 * | 10/2005 | McGarry | 42/1.05 |
| 2006/0185212 | A1 * | 8/2006 | Curry et al. | 42/46 |
| 2009/0071053 | A1 * | 3/2009 | Thomele et al. | 42/1.01 |
| 2010/0192438 | A1 * | 8/2010 | McGarry | 42/1.05 |
| 2010/0263254 | A1 * | 10/2010 | Glock | 42/71.02 |
| 2012/0167427 | A1 * | 7/2012 | Zukowski et al. | 42/25 |
| 2012/0317856 | A1 * | 12/2012 | Burke et al. | 42/16 |

* cited by examiner

*Primary Examiner* — Jonathan C Weber
(74) *Attorney, Agent, or Firm* — Fitch, Even, Tabin & Flannery LLP

(57) ABSTRACT

An extractor for a firearm and method of using the same are provided. The extractor comprises a bullet casing edge including a substantially straight portion and a tab portion situated below and extending from the substantially straight portion. The substantially straight portion is configured to engage the casing and enable it to travel vertically along the substantially straight portion while maintaining engagement therewith. The tab portion is configured to engage the casing and to inhibit it from traveling downward along the casing engagement edge below the tab portion.

19 Claims, 7 Drawing Sheets

EXTRACTOR FOR A FIREARM

BACKGROUND OF THE INVENTION

1. Field of the Invention

The present invention relates generally to firearms, and more specifically to extractors for firearms.

2. Discussion of the Related Art

Many current model handguns suffer from problems involving the ejection of the spent casings after firing. Particularly, many handgun models will exhibit erratic ejection or failed ejection. Beyond being simply annoying, erratic ejection can be dangerous as hot spent cartridges can fly onto the user's body or face or onto other nearby people, inflicting pain, startling the person, forcing the person to close their eyes, or exposing the person's eyes or airways to debilitating burning fumes and powders. In a combat or competition situation, this problem can be particularly dangerous as the distraction or debilitation of coming in contact with spent casings can expose the user or others to an enemy or cause the user or others to lose a competition. Further, failed ejections can require the user to physically remove or repair the firearm prior to shooting again, which is an option that simply might not be available in a combat or competition setting. Further, this problem can be exacerbated when using smaller caliber firearms, such as 9 mm. The problems can also become increasingly prevalent the more the firearm is used, often making the firearm unusable with any regularity after 1,500 to 2,000 shots.

Previous solutions have included modifying the ejector and cutting notches into breech walls and/or side walls of the slide. However, these solutions have failed to alleviate the problem with any significance or regularity. Further, the solution of cutting notches will require expensive re-tooling of slide manufacturing parts and is not easy or inexpensive to retrofit into an existing firearm, typically requiring replacement of the entire slide.

Therefore, there exists a desire for a solution to the problem of erratic ejection patterns and failed ejections that is inexpensive, versatile, and easily implemented in both new and existing firearms.

SUMMARY OF THE INVENTION

Several embodiments of the invention advantageously address the needs above as well as other needs by providing an extractor for a firearm and method of using the same. The extractor comprises a bullet casing engagement edge that is configured to engage an extractor groove an/or a casing rim of the bullet casing to extract the casing rearward from a barrel opening during recoil. In one aspect, the casing engagement edge comprises an upper portion having a substantially straight edge portion and configured to engage the casing and enable it to travel vertically along the upper portion while maintaining engagement therewith. In another aspect, the engagement edge also comprises a tab portion situated below and extending outward from the upper portion. The tab portion is also configured to engage the extractor grove and/or casing rim and to inhibit the bullet casing from traveling vertically downward along the casing engagement edge below the tab portion.

In a further embodiment, the tab portion of the casing engagement edge comprises a concave edge upper portion with an arc having a radius approximately equal or similar to a radius of the bullet casing, the casing extractor groove, or the casing rim.

BRIEF DESCRIPTION OF THE DRAWINGS

The above and other aspects, features and advantages of several embodiments of the present invention will be more apparent from the following more particular description thereof, presented in conjunction with the following drawings.

Figure 1:
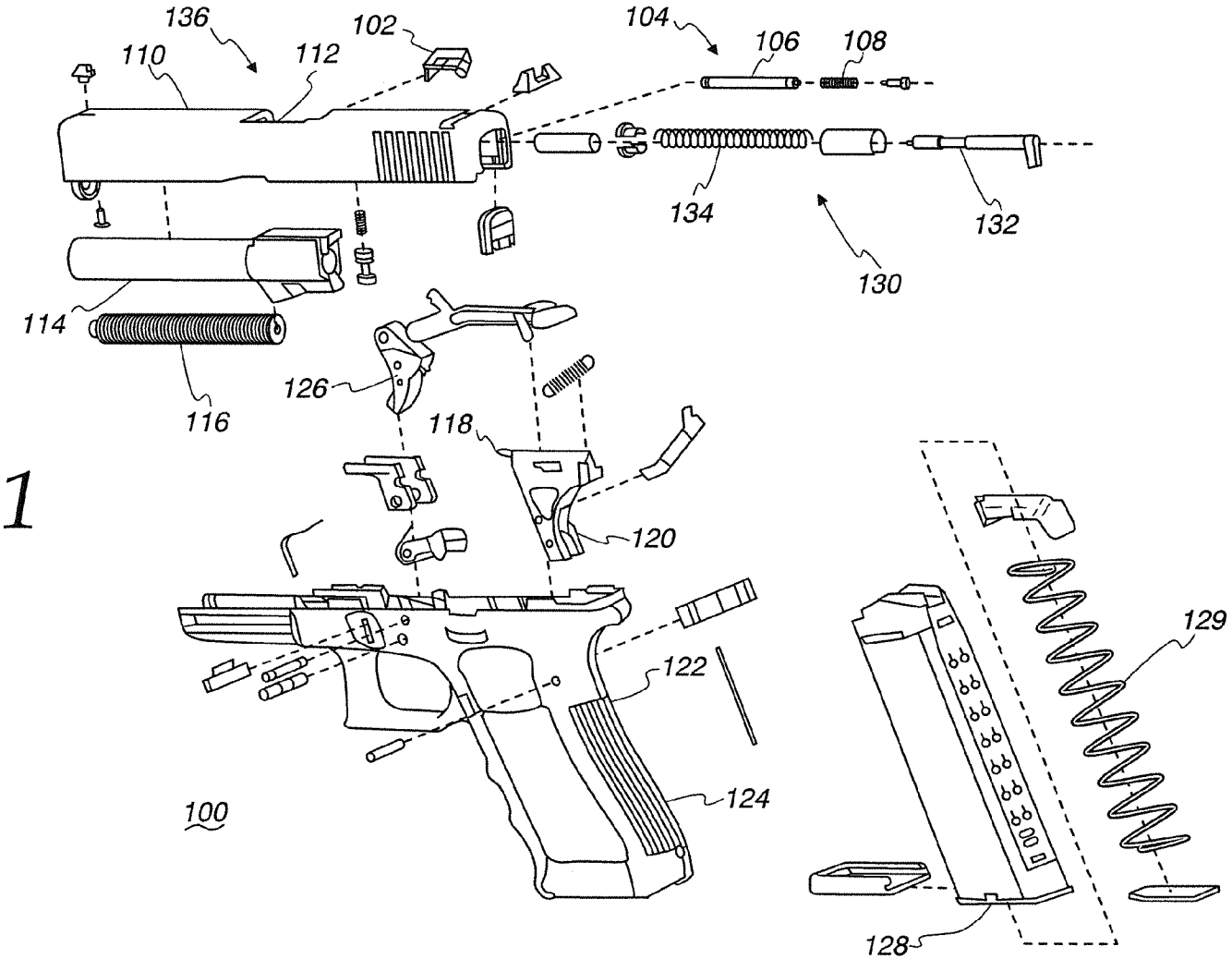
FIG. 1 is an exploded diagram of a firearm in accordance with various embodiments.

Corresponding reference characters indicate corresponding components throughout the several views of the drawings. Skilled artisans will appreciate that elements in the figures are illustrated for simplicity and clarity and have not necessarily been drawn to scale. For example, the dimensions of some of the elements in the figures may be exaggerated relative to other elements to help to improve understanding of various embodiments of the present invention. Also, common but well-understood elements that are useful or necessary in a commercially feasible embodiment are often not depicted in order to facilitate a less obstructed view of these various embodiments of the present invention.

DETAILED DESCRIPTION

The following description is not to be taken in a limiting sense, but is made merely for the purpose of describing the general principles of exemplary embodiments. The scope of the invention should be determined with reference to the claims.

Reference throughout this specification to "one embodiment," "an embodiment," or similar language means that a particular feature, structure, or characteristic described in connection with the embodiment is included in at least one embodiment of the present invention. Thus, appearances of the phrases "in one embodiment," "in an embodiment," and similar language throughout this specification may, but do not necessarily, all refer to the same embodiment.

Furthermore, the described features, structures, or characteristics of the invention may be combined in any suitable manner in one or more embodiments. In the following description, numerous specific details are provided, such as examples of various mechanical structures, components, settings, measurements, materials, finishes, manufacturing methods, operations, and the like to provide a thorough understanding of embodiments of the invention. One skilled in the relevant art will recognize, however, that the invention can be practiced without one or more of the specific details, or with other methods, components, materials, and so forth. In other instances, well-known structures, materials, or operations are not shown or described in detail to avoid obscuring aspects of the invention.

Referring first to FIG. 1, an exploded diagram of a firearm 100 is shown in accordance with various embodiments. The firearm 100 may comprise an extractor 102, an extractor plunger assembly 104 possibly including an extractor plunger 106 and an extractor plunger spring 108 amongst other parts, a slide 110, an ejection port 112, a barrel 114, a recoil spring 116, an ejector 118, a trigger housing 120, a frame 122, a handle 124, a trigger 126, a magazine 128, a magazine spring 129, a firing pin assembly 130 possibly including a firing pin 132 and a firing pin spring 134 in addition to other parts, and other components shown or not shown. As is shown in FIG. 1, the extractor 102 may be incorporated into a slide assembly 136 which may include the slide 110, the ejection port 112, the extractor 102, the extractor plunger assembly 104, the firing pin assembly 130, the barrel 114, the recoil spring 116, and various other components.

Figure 2:
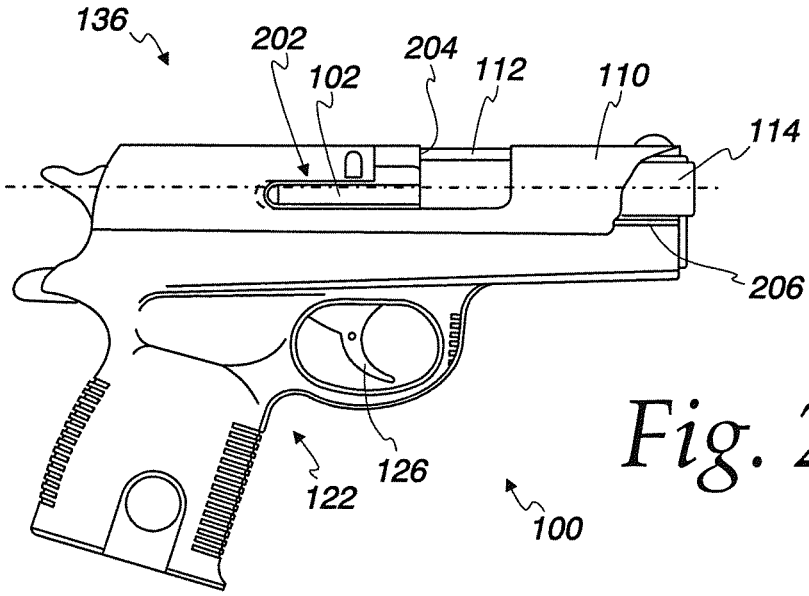
FIG. 2 is a view of the assembled firearm as shown in FIG. 1, in accordance with various embodiments.

Referring now to FIG. 2, a view of an assembled firearm 100 is illustrated in accordance with various embodiments. Shown more clearly in this opposite-side view are the ejection port 112, the extractor 102, an extractor slot 202, a breech wall 204, and the barrel 114. By most embodiments, the slide assembly 136 is slidably affixed to the frame 122 by rails 204 or other means so that it can slide rearward relative to the frame 122 during recoil after firing (or by manual cocking).

Figure 3:
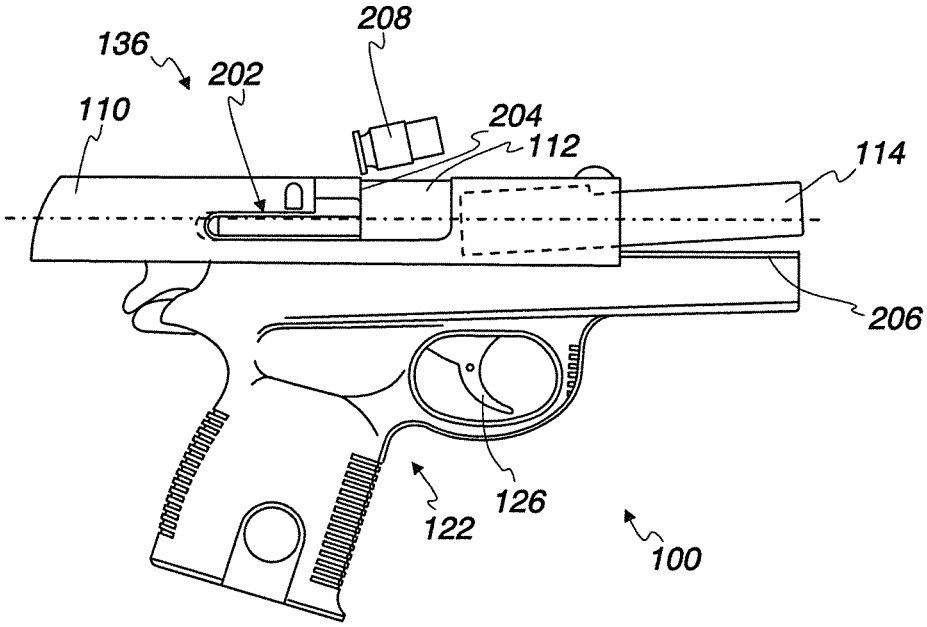
FIG. 3 is a view of the assembled firearm of FIG. 2 during recoil, in accordance with various embodiments.

Referring now to FIG. 3, a view of the firearm 100 during recoil is shown. Typically, after firing the firearm 100, the barrel 114 will slide rearward a short distance after the bullet has exited the front end of the barrel 114 due to forces exerted by the firing. This motion will also force the slide 110 to slide rearward due to interferences between the slide 110 and the barrel 114. During this rearward travel, the rear portion of the barrel 114 will articulate downward as is shown in FIG. 3 and interferences between the barrel 114 and the slide 110 will disengage. The slide 110 will then be free to slide rearward relatively free of the barrel 114. At this point, the barrel 114 will then remain largely stationary in terms of forward and aft movement (compared to the frame 122) as the slide 110 continues to travel rearward. Also shown is the spent casing 208 being ejected from the firearm 100.

Figure 4:
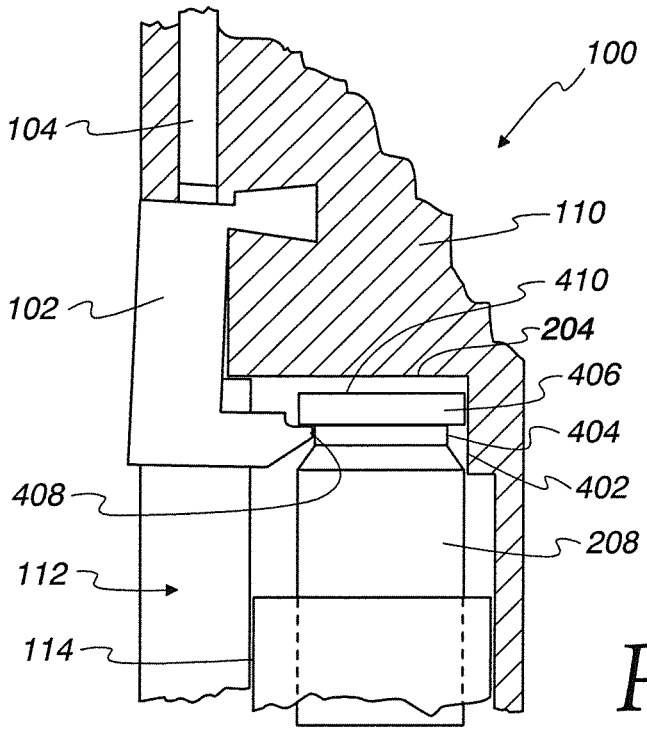
FIG. 4 is a top-down section view of the firearm of FIG. 2 during recoil.

Referring now to FIG. 4, a top-down sectional view of the firearm 100 during recoil is shown. Shown is the slide 110, the ejection port 112, the breech wall 204, a breech sidewall 402, the extractor 102, the extractor plunger assembly 104, the barrel 114, and the bullet casing 208. The bullet casing 208 includes an extractor groove 404 near the rear of the casing 208 and a casing rim 406 at the rear of the casing 208. The extractor 102 engages the extractor groove 404 and/or the casing rim 406 at the casing engagement edge 408 of the extractor 102. As the slide 110 continues to move rearward and the barrel's 114 rearward movement is halted, the extractor 102 will pull the spent bullet casing 208 from the rear opening of the barrel 114 allowing the spent casing 208 to travel rearward with the slide 110. During recoil, as the slide 110 moves rearward relative to the barrel 114, the ejection port 112, which is normally occupied by a portion of the barrel 114 when in forward "battery" position, will slide rearward relative to the barrel 114 and frame 122 and expose a bullet chamber and the spent casing 208, as is shown in FIG. 3.

Figure 5:
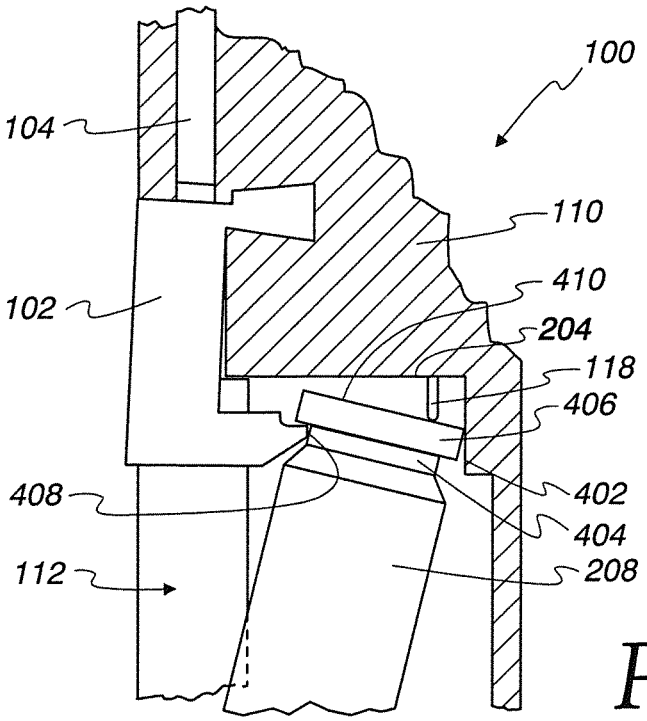
FIG. 5 is another top-down section view of the firearm of FIG. 2 during recoil.

Referring now to FIG. 5, a second view of the top-down view of the firearm 100 during recoil is shown. As the extractor 102 continues to move the spent casing 208 rearward with the slide 110, a rear surface 410 of the casing 208 will impact with an ejector 118 (typically an ejector pin) that is typically stationary with respect to the frame 122, possibly as part of a trigger housing 120 assembly. Upon this impact, the spent casing 208 will rotate or yaw about the casing engagement edge 408 of the extractor 102 until the casing 208 is no longer engaged by the extractor 102 and will resultantly be ejected out of the ejection port 112 as is shown in FIG. 3.

After ejection, a new cartridge comprising the bullet and casing 208 are moved upward from the magazine 128 into the bullet chamber. The slide 110, under compression force by the recoil spring 116, moves forward and pushed the new bullet and casing 208 forward into the rear opening of the barrel 114 by interference between the breech wall 204 of the slide 110 within the bullet chamber and the rear surface 410 of the new casing 208. The slide 110 will continue its forward travel and the rear portion of the barrel 114 will articulate back up and will receive the bullet. Upon completion of the slide's 110 forward travel the firearm 100 will ready to be fired once again.

As was mentioned in the background, erratic ejection patters and failed ejection are both annoying and dangers to user of firearms 100 and individuals in close proximity to them. Currently, modern striker-fired handgun manufactures have failed to solve the problem, and other previous solutions have failed to remedy this problem with any significance or regularity.

The applicant has determined that a root cause of these problems is that upon recoil, while the casing 208 is being extracted from the downwardly articulated barrel 114, the casing 208 can dip below a certain position, which causes a host of different problems. First, if the casing 208 is below the certain position when the rear of the casing 208 impacts the ejector 118, which is stationary with respect to the frame 122, that impact point will be higher on the rear surface 410 of the casing 208. This in turn decreases the angle at which the casing 208 is ejected and causes the casing 208 to eject in a more sideways fashion rather than vertical or diagonal, which is more ideal. As multiple different casings 208 are fired and drop below the above referenced certain position by varying amounts, the ejector 118 will impact the different casings 208 at different points on their rear surfaces 410 causing the spent casings 208 to eject at different angles resulting in an erratic ejection patter. Further, if the angle of ejection is too divergent, the casings 208 can reflect off of various surfaces of the chamber or ejection port 112 and result in a failed ejection such as stove piping (where the casing 208 becomes trapped between the barrel 114 and the breech wall 204 or the rear surface of the ejection port 112) or simply a failing to extract.

Second, if the casing 208 drops down far enough, it can lose contact with the engagement edge 408 of the extractor 102. If the rear surface 410 of the casing 208 impacts the ejector 118 without maintaining contact with the engagement edge 408, the casing 208 will have nothing about which to rotate or pivot during ejection and the casing 208 can be ejected at a random angle or fail to eject all together. Alternatively, if the casing 208 loses contact or engagement with the extractor 102, the casing 208 may not fully extract from the barrel 114 and may remain in the barrel 114 upon completion of recoil, thereby preventing the next round from entering the barrel 114 and disabling the firearm 100 until such time as the casing can be removed manually.

Third, as the casing 208 drops down during recoil, the casing 208 can rely upon an upward force exerted on the bottom of the casing 208 by the magazine spring 129. This upward force can cause the casing 208 to bounce upward in a sporadic manner, thus adding to the erratic ejection pattern and ejection failure possibility. Further, this upward force is not consistent as rounds are emptied out of the magazine 128 and the magazine spring 129 decompresses and exerts less upward force on the casing 208. While firing the last rounds of the magazine 128, the magazine spring 129 will exert the least amount of upward force on the casing 208 and may allow the casing 208 to drop even lower, thus causing more potential for erratic or failed ejection as the magazine 129 is unloaded.

Fourth, due to manufacturing tolerances, some firearms 100 will articulate the rearward portion of the barrel 114 down further than others, thus resulting in higher probability of erratic and failed ejections.

Fifth, wear over time will exasperate the above identified problems. Particularly, the engagement edge 408 can begin to burnish (i.e., become polished), at which point the friction to hold the casing 208 at or above the referenced certain position is decreased and the casing 208 is more likely to drop below this position, resulting in the above described problems. Also, if the extractor 102 exists in the slide 110 in an angled configuration (see FIG. 7), wear on the top and bottom surfaces 612, 614 of the extractor (see FIG. 6) can cause the extractor 102 to dip down further and create a downward angle by the engagement edge 408 of the extractor 102 that pushes the casing 208 downward instead of against the breech sidewall of the chamber. This can add to the likelihood of erratic and failed ejections.

Sixth, some manufactures have included a visual loaded chamber indicator feature to their firearms 100. This feature is affected by angling the engagement edge 408 of the extractor 102 to face slightly downward. By this, as the casing 208 travels upward on the engagement edge 408 when the barrel 114 articulates upward and the firearm 100 enters the battery position, the casing 208, opposed by the breech sidewall 402, pushes the extractor 102 outward so that a lateral exterior surface 606 (see FIG. 6) of the extractor 102 will protrude from the side of the slide 110. This gives the user a visual and tactile indication that the chamber is loaded. However, this feature, due to the downward angled engagement edge 408, also adds additional downward forces on the casing 208, causing it to drop lower. As wear progresses and the engagement edge 408 becomes burnished, thus lessening the friction, the more likely the casing 208 is pushed downward by the downward facing engagement edge 408. By this, the addition of this feature can actually add to the problem.

The applicant has determined that a way to alleviate these problems is to prevent the casing 208 from dropping below too low and especially to prevent the casing 208 from dropping below the lowest point where it maintains engagement with the engagement edge 408 of the extractor 102 during recoil. Thus, the following modified extractor 102 is hereby disclosed.

Figure 6:
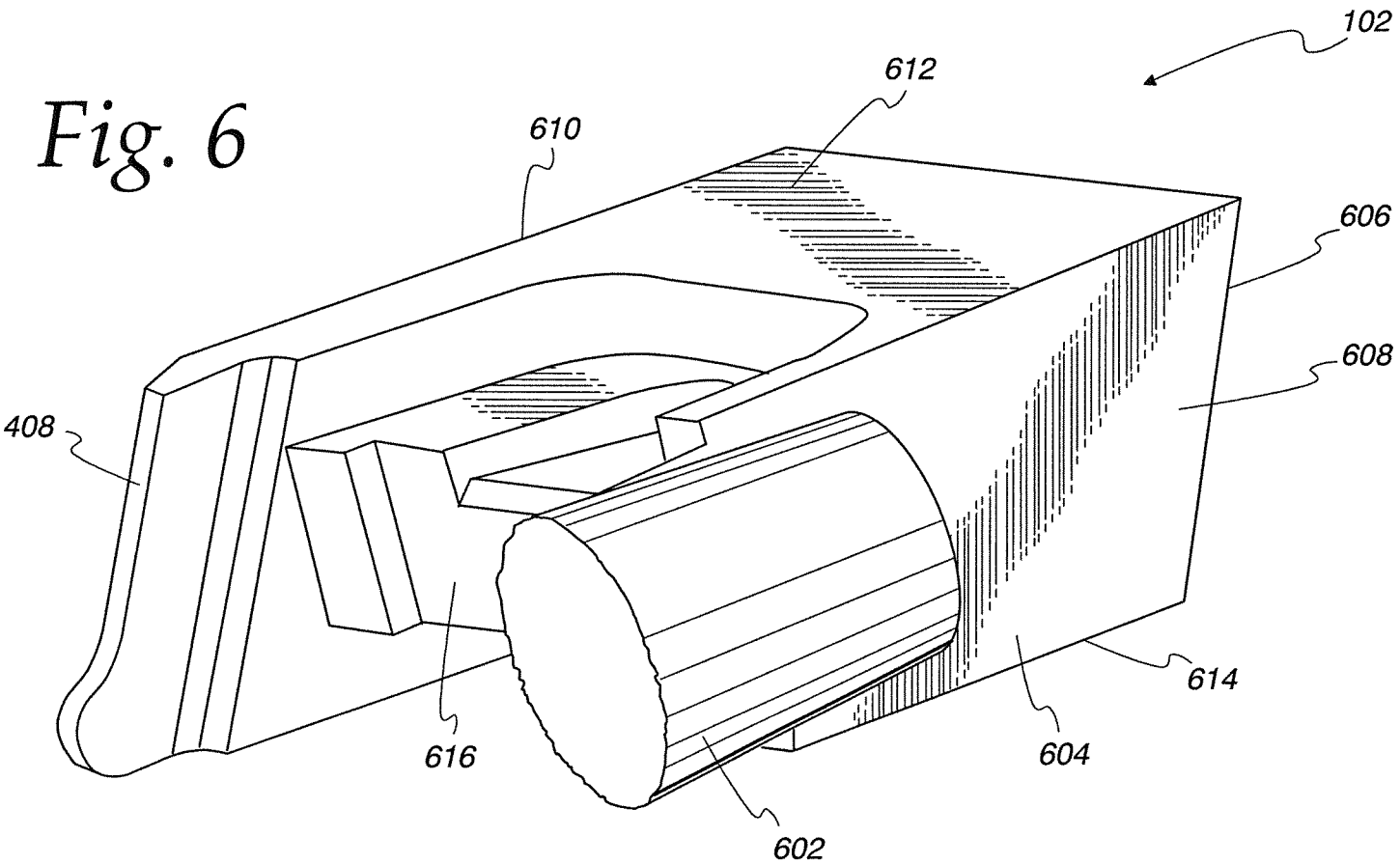
FIG. 6 is an illustration of an extractor for use in the firearm of FIG. 2 in accordance with various embodiments.

Referring now to FIG. 6, an illustration of an extractor 102 for a firearm 100 is illustrated in accordance with various embodiments. By one embodiment, the extractor 102, shown from the rear in FIG. 6, comprises a conical stopper portion 602, a body 604, a lateral exterior surface 606, a rear surface 608, a front surface 610, a top surface 612, a bottom surface 614, a support portion 616, and the bullet casing engagement edge 408. In this embodiment, the body 604 resembles a sideways "U" with the lateral exterior surface 606 situated on the bottom of the "U" shape. At one end of the "U" (the rear end) is the conical stopper portion 602 with a longitudinal axis of the conical stopper 602 extending away from the body 604 with an increasing radius. At the other end (front end) of the "U" shape is the bullet casing engagement edge 408. Occupying much of the space in the middle of the "U" of the body 604 is the support portion 616. The extractor 102 is situated in the slide 110 in the extractor slot 202 and is pivotably articulable about a pivot point established by interference between the conical stopper 602 and a corresponding receiving portion of the slide 110. A force is exerted by the extractor plunger assembly 104 onto the rear surface 608, resulting in a torque on the extractor 102 about the pivot point. This torque results in a lateral force exerted by the casing engagement edge 408 on the casing 208.

By one embodiment, the extractor 102 is angled so as to exist in the extractor slot 202 of the slide 110 at an angle relative to a lateral axis of the firearm 100 (see FIGS. 8 and 9) making an angle of articulation of the extractor 102 also at an angle to the vertical axis of the firearm 100. In such a configuration, the extractor 102 may possibly resemble a parallelogram with the top 612 and bottom 614 surfaces being substantially parallel to each other, the front 610 and rear 608 surfaces being substantially parallel to each other, and the lateral exterior surface 606 being substantially parallel to at least a line defined by a substantially straight edge portion 702 (see FIG. 7) of the casing engagement edge 408. However, these surfaces and edges may not be exactly parallel, and may be advantageously slightly or entirely off of parallel by some embodiments. As shown in FIG. 4, an acute angle may exist between the top surface 612 and the lateral exterior surface 606 and an obtuse angle may exist between the top surface 612 and the line defined by the substantially straight edge portion 702 of the casing engagement edge 408.

As the bullet casing 208 enters the chamber from the magazine 128 below and begins to the engage the casing engagement edge 408 of the extractor 102 and causes the extractor 102 to articulate outward to accommodate the casing 208, an advantage exists to the angular configuration when in that a force between the top surface 612 of the extractor 102 or a top surface of the support portion 616 of the extractor 102 is reduced and the extractor 102 is able to more easily articulate outward to accommodate the casing 208 incoming from below. This can allow for less friction and force resisting the entry of the casing 208 into the chamber from below as well as reduce wear and failure. Example firearms 100 with such an angled configuration include various ones of the Glock® family of handguns including but not limited to generation 3 and 4 9 mm, 0.40, and 0.45 handguns.

In other embodiments, however, the extractor 102 may be situated in the extractor slot 202 in the slide 110 in a manner that is parallel to the lateral axis of the firearm 100 (i.e., straight-in) or closer to parallel than is illustrated in FIG. 4. Example firearms 100 with such a configuration include the M&P® series firearms by Smith & Wesson®, including the 9 mm, the 0.40, and the 0.45 models. Other advantages may be apparent with such a configuration and the current disclosure is entirely compatible with and contemplates such straight-in applications.

Figure 7:
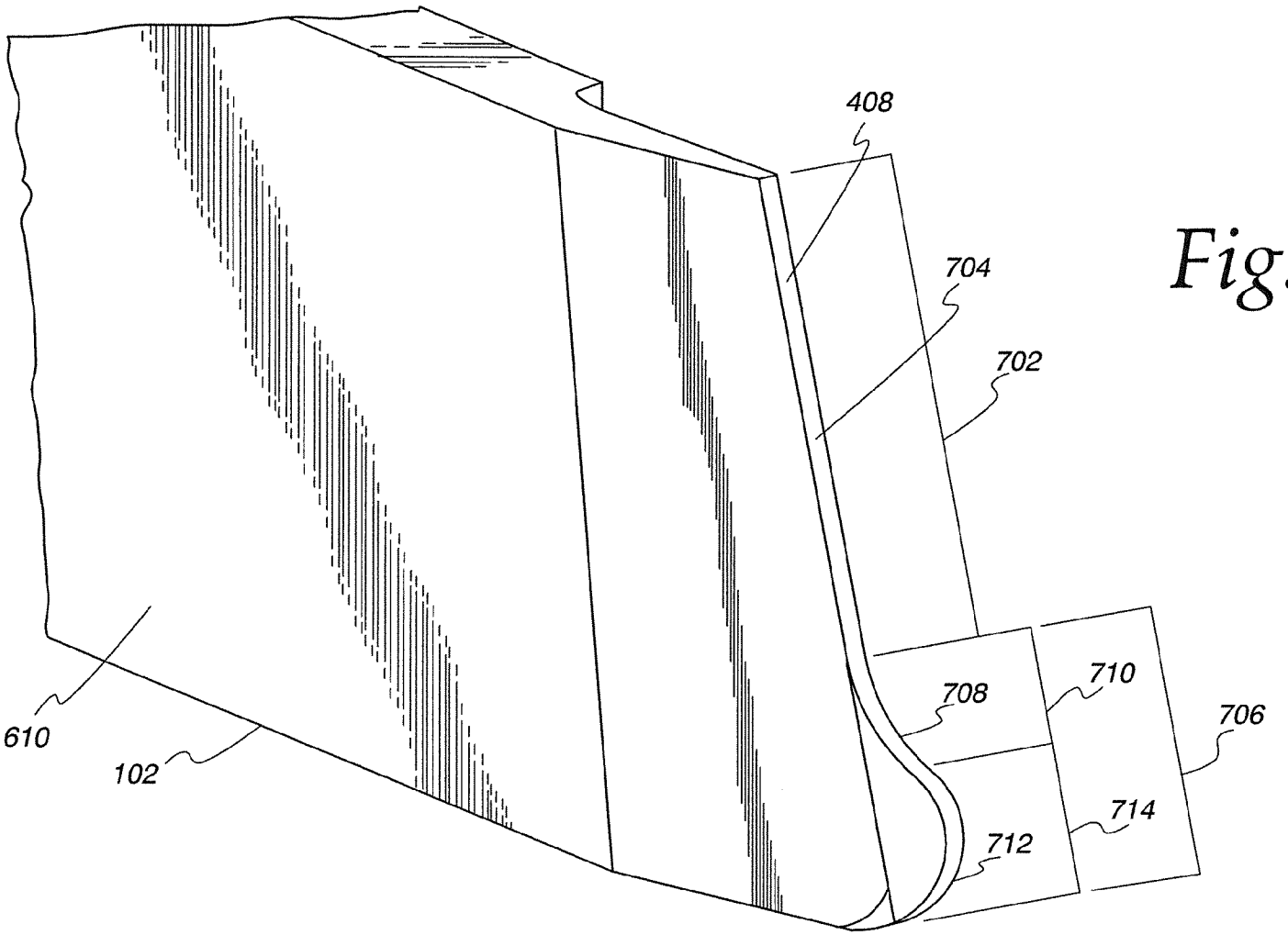
FIG. 7 is an illustration of the casing engagement edge of the extractor of FIG. 6, in accordance with various embodiments.

With reference now to FIG. 7, which illustrates the casing engagement edge 408 in further detail, the casing engagement edge 408 comprises an upper portion 702 at least partially comprising a substantially straight edge portion 704. The casing engagement edge 408 also comprises a tab portion 706 situated below the upper portion 702 and extending outward from the upper portion 702. By one embodiment, the tab portion 706 comprises a concave edge portion 708 on an upper portion 710 of the tab portion 706. By another embodiment, the tab portion 706 further comprises a rounded convex edge portion 712 on a lower outer portion 714 of the tab portion 706. Other shapes and configurations with respect to the tab portion 706 are possible, such as two straight edges at angles from the substantially straight edge 704 (essentially making a sharper point), a square or rectangular tab, or any shape or combination of shapes that at least partially extends outward from the substantially straight edge portion 704.

The upper portion 702 with the substantially straight edge portion 704 is configured to engage the casing extractor groove 404 or the casing rim 406 and enable the casing 208 to travel vertically along the upper portion 702 while maintaining engagement therewith.

Figure 8:
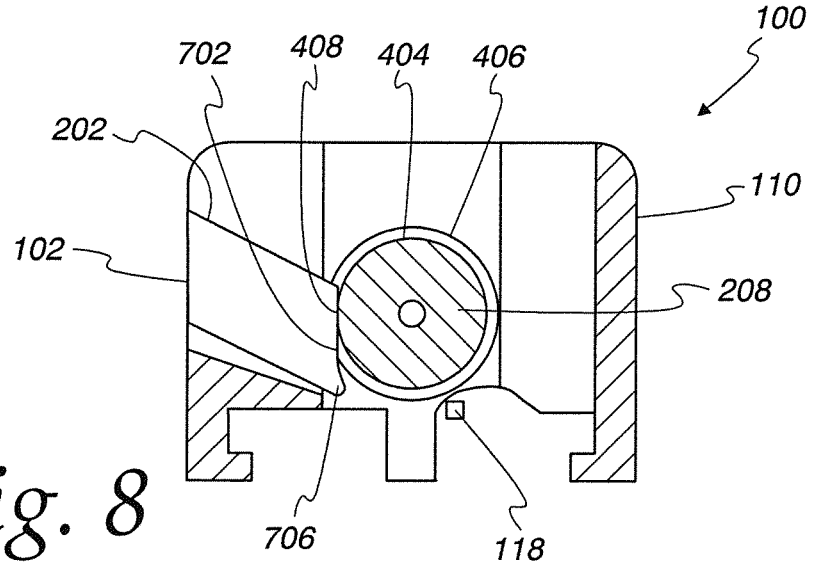
FIGS. 8 and 9 show sectional views of pertinent portions of the firearm, in accordance with various embodiments.
Figure 9:
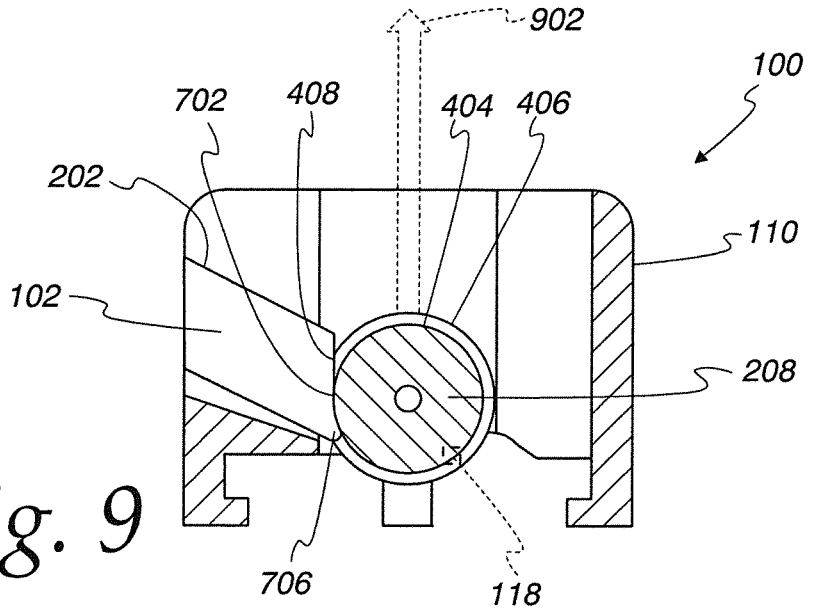

Referring now to FIGS. 8 and 9, sectional views of pertinent portions of the firearm 100 are shown from the front in accordance with various embodiments. The extractor 102 is shown situated in the extractor slot 202 in the slide 110 with the casing engagement edge 408 engaging the extractor groove 404 and/or casing rim 406 of the casing 208. FIG. 8 shows the casing 208 in an upward position, as when the slide 110 is locked forward in the battery position, the rear part of the barrel 114 is articulated upward, and the firearm 100 is ready to fire. FIG. 9, conversely, shows the casing 208 in a downward position, as during recoil after the rear part of the barrel 114 has articulated downward. The upper portion 702 of the casing engagement edge 408 allows the casing 208 to travel vertically downward (or upward) while maintaining contact with the extractor groove 404 or casing rim 406 as shown in FIGS. 8 and 9.

With continuing reference to FIG. 9, which shows the casing 208 in the downward position during recoil, the tab portion 706 of the casing engagement edge 408 may engage the extractor groove 404 and/or casing rim 406. The tab portion 706 inhibits the casing 208 from traveling vertically downward along the casing engagement edge 408 below the tab portion 706. By preventing the rear of the casing 208 from traveling further down, the casing 208 will maintain engagement with the extractor 102 until ejection and also be prevented from relying on or being negatively influenced by the magazine spring 129. This also maintains at least a minimum angle of ejection by allowing the ejector 118 to impact the casing 208 on a consistently lower portion of rear surface 410 of the casing 208. These effects result in a more consistent and reliable ejection.

By some embodiments, the tab portion 706 is configured such that it will maintain this engagement at least during a segment of the recoil action leading up to the exertion of the ejection force on the bullet casing 208 by the ejector 118. By at least one embodiment, the tab portion 706 exerts an upward force 902 on the bullet casing 208 during this segment leading up to the exertion of the ejection force on the rear surface 410 of the casing 208 by the ejector 118. By another embodiment, this upward force 902 is greater than approximately 3 pounds, and by another embodiment is greater than approximately 4 pounds, though other upward force values may be possible and appropriate. By the tab portion 706 maintaining its engagement with extractor groove 404 or casing rim 406 of the casing 208, and even exerting the upward force 902 upon the casing 208 leading up to impact with the ejector 118, the tab portion 706 not only ensures that the casing 208 does not drop too low, but the tab portion 706 will locate the casing 208 in a consistent location with respect to the ejector 118 time after time, resulting in a highly consistent ejection pattern with extremely low ejection failure rate. By one embodiment, the tab portion 706 consistently locates the casing 208 such that the ejector 118 consistently impacts the rear surface 410 of the casings 208 at a position in a slice of the rear surface 410 between 90 degrees and 150 degrees (assuming straight up is 0 degrees). More specifically, the casing 208 is consistently located such that the ejector 118 impacts the rear surface 410 of the casing 208 at around 120 degrees.

By another embodiment, as a result of such consistent location, the ejection pattern comprises ejecting the bullet casing 208 consistently between approximately 120 degrees and 165 degrees from the ejection port 112 as viewed from above with the front of the barrel 114 indicating 0 degrees. So configured, the casings 208 will eject to the right side of the user, landing next to or slightly behind the user.

Figure 10:
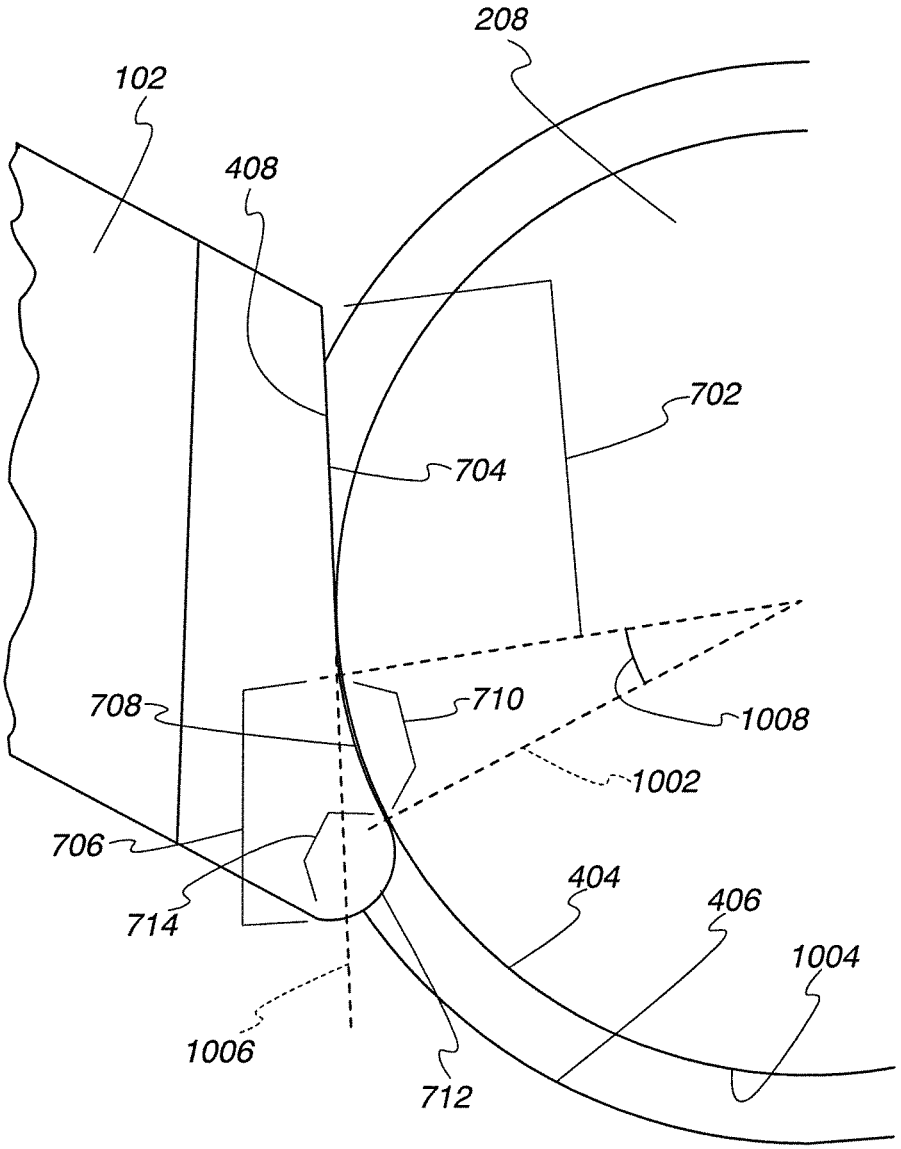
FIG. 10 is a close up of a cross-sectional of the interaction between the casing engagement edge and the casing is shown in accordance with at least one embodiment.

Referring now to FIG. 10, a close up of a cross-sectional of the interaction between the casing engagement edge 408 and the casing 208 is shown in accordance with at least one embodiment. The engagement edge 408, including the upper portion 702, comprising the substantially straight edge portion 704, and the tab portion 706, engages the extractor groove 404 and/or the casing rim 406 on the casing 208. By one embodiment, the concave edge portion 708 on the upper portion 710 of the tab portion 706 of the engagement edge 408 comprises an arc with a radius 1002 that is approximately equal to the radius of the extractor groove 404, or more specifically, a recessed surface 1004 of the extractor groove 404. Alternatively, the arc may have a radius 1002 approximately equal to the radius of the bullet casing 208 or the bullet casing rim 406. Alternatively even still, the arc may have any radius 1002 that is smaller than described above (so that it is more severe of a "hook"), or even larger (so that it is more subtle of a "hook"), as long as the selected radius 1002 allows the tab portion 706 to inhibit the casing 208 from traveling downward below the tab portion 706. A preferred embodiment is to set the radius 1002 close to or the same as the radius of the extractor groove 404 so as to minimize point stresses on the tab portion 706, which could break or wear more severely than a contact surface that is larger due to matched radius 1002.

To further avoiding stress points, the concave edge portion may be substantially tangential to the substantially straight edge portion 704. This is illustrated by the dashed line 1006 representing the imaginary continuance of the substantially straight edge portion 704 and the concave edge portion's 708 relation thereto.

By another embodiment, the arc of the concave edge portion 708 of the upper portion 710 of the tab portion 706 has a central angle 1008 of approximately between 28 and 38 degrees. By other embodiments, the central angle 1008 is between 30 and 36 degrees, or between 32 and 34 degrees, or is approximately 32.5 degrees. By yet another embodiment, an extractor 102 suited for a 9 mm casing and possibly for use in a Glock® semi-automatic 9 mm handgun, may have an arc length of approximately 0.05 inches. Other handgun manufactures and models, such the Smith & Wesson® M&P® line of handguns, may employ extractors 102 with a longer engagement edge 408 to engage the casing 208, thus allowing for a larger arc central angle 1008 or arc length. The measurements disclosed herein may be ideally suited for a Glock® using a 9 mm casing 208, but may be scaled as appropriate when using larger shells or firearms with larger casing engagement edges 408.

In a further embodiment, the tab portion 706 further comprises the rounded convex edge portion 712 configured to engage the extractor groove 404 and/or the casing rim 406 of the casing 208 and to enable the casing 208 to travel vertically upward along the tab portion 706 of the casing engagement edge 408. After a casing 208 is ejected and the next casing 208 is rising out of the magazine 128, the new casing 208 will align with and engage the casing engagement edge 408 from the lower outer portion 714 of the tab portion 706 and slide upward toward the substantially straight edge portion 704. Thus, the tab portion 706 allows a cartridge to slide upward along the breech sidewall 402 relatively unhindered, but prevents the casing 208 from slipping below the lowest contact point with the casing engagement edge 408 as the barrel 114 articulates downward during recoil. The tab portion 706 also consistently locates the casing 208 relative to the ejector 118 to result in a more consistent and reliable ejection pattern.

By including the tab portion 706 as described herein in its various embodiments on the engagement edge 408 of the extractor 102, an efficient solution is provided that remedies the problems identified above. In particular, the tab portion 706 remedies the problems caused by the casing 208 dropping too low, loosing engagement with the casing engagement edge 408 of the extractor 102, or interacting with the magazine spring 129. Also, by simply changing one relatively inexpensive part rather than multiple expensive parts, the presented solution is efficient, economical, and easy to implement. Further, because the tab portion 706 will set the lower distance which the casing 208 may travel downward, many of the other issues identified above as exasperating factors, such as poor manufacturing tolerances, wear of the extractor 102, and incorporation of a visual loaded chamber indicator, are all by eliminated from concern as they cannot and do not override the downward-movement-limiting effect of the tab portion 706. Moreover, the disclosed design can be modified to incorporate the visual chamber indicator feature as the downward force exerted by a downward angled substantially straight edge portion 704 of the engagement edge 408 does not exceed the upward force 902 exerted by the tab portion 706 on the casing 208, and thus, will not push the casing 208 below the tab portion 706 and out of engagement with the casing engagement edge 408.

While the invention herein disclosed has been described by means of specific embodiments, examples and applications thereof, numerous modifications and variations could be made thereto by those skilled in the art without departing from the scope of the invention set forth in the claims.

What is claimed is:

1. An extractor for a firearm comprising:

a casing engagement edge configured to engage at least one of a casing extractor groove and a casing rim of a bullet casing and to extract the bullet casing rearward from a barrel opening of a firearm, the casing engagement edge comprising:

an upper portion comprising a substantially straight edge, the upper portion configured to engage the at least one of the casing extractor groove and the casing rim and including a length such that, after firing, the casing travels downward along the length of the upper portion, maintaining engagement with the upper portion, prior to impact of the casing by an ejector of the firearm; and a tab portion situated below the upper portion and extending outward from the upper portion, the tab portion including an upper tab portion shaped to maintain engagement with the at least one of the casing extractor groove and the casing rim after the bullet casing has traveled vertically downward along the substantially straight edge of the upper portion but prior to impact of the casing by the ejector, the upper tab portion comprising a concave edge with a radius of curvature, the tab portion further including a lower tab portion comprising a rounded convex edge, the tab portion extending outward a distance sufficient to inhibit the bullet casing from traveling further vertically downward along the substantially straight edge of the upper portion, whereby upon ejection the casing is engaged with the tab portion and the casing is located in a consistent location with respect to the ejector.

2. The extractor of claim 1 wherein the tab portion is further configured such that the tab portion maintains engagement with the casing engagement edge during a segment of a recoil action leading up to an exertion of an ejection force on the bullet casing after firing the firearm.

3. The extractor of claim 2 wherein the tab portion is configured to exert an upward force on the bullet casing during the segment of the recoil action leading up to the exertion of the ejection force on the bullet casing.

4. The extractor of claim 3 wherein the upward force exerted on the bullet casing comprises a force greater than approximately 3 pounds in the upward direction.

5. The extractor of claim 1 wherein the radius of curvature of the concave edge is approximately equal to a radius of at least one of the bullet casing, the extractor groove, and the casing rim.

6. The extractor of claim 5 wherein the concave edge is substantially tangential to the substantially straight edge of the upper portion.

7. The extractor of claim 5 wherein the arc of the concave edge has a central angle of approximately 28-38 degrees.

8. A method comprising:

exerting by an extractor a rearward force on a bullet casing to extract the bullet casing from a barrel opening of a firearm during at least a segment of a recoil action of the firearm after firing the firearm;

traveling of the bullet casing vertically downward along a substantially straight edge of an upper portion of a casing engagement edge of the extractor, the upper portion configured to engage at least one of a casing extractor groove and a casing rim of the bullet casing, the upper portion including a length such that, after firing, the casing travels downward along the length of the upper portion, maintaining engagement with the upper portion, prior to impact of the casing by an ejector of the firearm;

engaging the casing by a tab portion of the casing engagement edge, the tab portion situated below the upper portion and extending outward from the substantially straight edge of the upper portion, the tab portion including an upper tab portion shaped to maintain engagement with the at least one of the casing extractor groove and the casing rim after the bullet casing has traveled vertically downward along the substantially straight edge of the upper portion but prior to impact of the casing by an ejector, the upper tab portion comprising a concave edge with a radius of curvature, the tab portion further including a lower tab portion comprising a rounded convex edge; and inhibiting, by the tab portion, the bullet casing from traveling further vertically downward along the substantially straight edge of the upper portion, whereby upon ejection the casing is engaged with the tab portion and the casing is located in a consistent location with respect to the ejector.

9. The method of claim 8 wherein the inhibiting by the tab portion further comprises inhibiting of the bullet casing from traveling vertically downward during a segment of the recoil action leading up to an exertion of an ejection force on the bullet casing after firing the firearm.

10. The method of claim 9 further comprising the tab portion exerting an upward force on the bullet casing during the segment of the recoil action leading up to the exertion of the ejection force on the bullet casing.

11. The method of claim 10 wherein the upward force exerted on the bullet casing comprises a force greater than approximately 3 pounds in the upward direction.

12. The method of claim 8 wherein the radius of curvature of the concave edge is approximately equal to the radius of at least one of the bullet casing, the extractor groove, and the casing rim.

13. The method of claim 12 wherein the concave edge is substantially tangential to the substantially straight portion of the engagement edge.

14. The method of claim 12 wherein the arc of the concave edge has a central angle of approximately 28-38 degrees.

15. The method of claim 8 wherein the rounded convex edge of the lower tab portion engages the at least one of the casing extractor groove and the casing rim to enable a new casing to travel vertically upward along the tab portion of the engagement edge when the new casing is rising out of a magazine.

16. A firearm comprising:

a barrel comprising a rear barrel opening;

a casing extractor, the casing extractor comprising:

a casing engagement edge configured to engage a casing extractor groove of a bullet casing and to extract the bullet casing from the rear barrel opening, the casing engagement edge comprising:

an upper portion comprising a substantially straight edge and configured to engage the casing extractor groove and to enable the bullet casing to travel vertically along the substantially straight upper portion, the upper portion including a length such that, after firing, the casing travels downward along the length of the upper portion, maintaining engagement with the upper portion, prior to impact of the casing by an ejector of the firearm;

a tab portion situated below the upper portion and extending outward from the substantially straight edge of the upper portion, the tab portion comprising a concave edge on an upper portion of the tab portion having a radius of curvature approximately equal to a radius of the casing extractor groove and being approximately tangential to the substantially straight edge, the tab portion further including a lower tab portion comprising a rounded convex edge, the tab portion configured to engage the casing extractor groove and extending outward a distance sufficient to inhibit the bullet casing from traveling further vertically downward along the substantially straight edge of the upper portion, whereby upon ejection the casing is engaged with the tab portion and the casing is located in a consistent location with respect to the ejector during a segment of a recoil action of the firearm leading up to an exertion of an ejection force on the bullet casing during the recoil action.

17. The firearm of claim 16, the ejector further comprising:

an ejector pin configured to exert the ejection force on the bullet casing during the recoil action.

18. The firearm of claim 17 wherein the firearm is configured to produce a consistent bullet casing ejection pattern.

19. The firearm of claim 18 wherein the consistent bullet casing ejection pattern comprises ejecting the bullet casing consistently between approximately 120 degrees and 165 degrees relative to a longitudinal axis of the barrel as viewed from above the firearm with the front of the barrel indicating 0 degrees.

* * * * *